United States Patent [19]

Thomas et al.

[11] Patent Number: 4,605,598

[45] Date of Patent: Aug. 12, 1986

[54] STEEL WIRE HAVING SUPERPOSED COATINGS RESISTING CORROSION

[75] Inventors: Bruno Thomas, Loos-en-Gohelle; Guy Viart, Capelle Fermont, both of France

[73] Assignee: Fils et Cables D'Acier de Lens (Fical), Loison-Sous-Lens, France

[21] Appl. No.: 624,961

[22] Filed: Jun. 26, 1984

[30] Foreign Application Priority Data

Jun. 28, 1983 [FR] France ..... 83 10660

[51] Int. Cl.[4] ..... B32B 15/00

[52] U.S. Cl. ..... 428/659; 428/379; 428/389

[58] Field of Search ..... 428/548, 615, 638, 650, 428/653, 654, 658, 659, 681, 684, 685, 379

[56] References Cited

U.S. PATENT DOCUMENTS

| | | | |
|---|---|---|---|
| 1,307,853 | 6/1919 | Dimm | 428/659 X |
| 1,468,905 | 9/1923 | Herman | 428/659 X |
| 2,068,904 | 1/1937 | Bradley . | |
| 2,069,658 | 2/1937 | Renkin | 428/659 |
| 3,190,768 | 6/1965 | Wright | 428/659 X |
| 3,320,040 | 5/1967 | Roe et al. | 428/659 |
| 3,343,930 | 9/1967 | Borzillo et al. | 428/653 |
| 3,393,089 | 7/1968 | Borzillo et al. | 427/329 |
| 3,952,120 | 4/1976 | Horton et al. . | |
| 4,056,366 | 11/1977 | Lee et al. | 428/659 X |
| 4,128,676 | 12/1978 | Lee | 428/659 X |
| 4,152,472 | 5/1979 | Ohbu et al. | 428/659 X |
| 4,202,921 | 5/1980 | Enghag | 428/659 X |
| 4,350,539 | 9/1982 | Torok et al. | 428/653 X |
| 4,448,748 | 5/1984 | Radtke et al. | 428/659 X |

FOREIGN PATENT DOCUMENTS

| | | |
|---|---|---|
| 0037143 | 10/1981 | European Pat. Off. . |
| 2146376 | 3/1972 | Fed. Rep. of Germany . |

OTHER PUBLICATIONS

Chemical Abstracts, 6001, vol. 90 (1979) Jun., No. 26, p. 270.

Chemical Abstracts, vol. 90, (1979) No. 26, p. 257.

*Primary Examiner*—Lorraine T. Kendell

*Attorney, Agent, or Firm*—Wenderoth, Lind & Ponack

[57] ABSTRACT

A perfectly ductile hard steel wire having superposed coatings resisting corrosion. The wire is coated with a first inner layer A1 (Al-Fe-Zn) and a second outer layer A2 (Zn-Al-Fe) and the first inner coating layer has the following composition:

| | |
|---|---|
| Al | Al between 15% and 45%<br>Fe between 5% and 25%<br>Zn forming the balance with elements of addition in a small amount, such as Mg, Sn, Ni, Cu, Cr, Mischmetal, etc. . . the total amount of which does not exceed 0.5%. |

This wire has a resistance to corrosion very much higher than that of conventional galvanized wires and that of similar Zn-Al coatings which had been deposited in a single stage.

1 Claim, No Drawings

STEEL WIRE HAVING SUPERPOSED COATINGS RESISTING CORROSION

The present invention relates to a hard steel wire having a high carbon content and perfectly ductile employed in the manufacture of cables and springs, and having a protective coating formed by a plurality of layers of different alloys containing zinc, aluminium and iron.

According to the invention, the wire is coated with a first inner layer of alloy A1 (Al-Fe-Zn) containing at least 15% of aluminium and a second outer layer A2 (Zn-Al-Fe) containing at least 3% of aluminium and 90% of zinc.

According to one embodiment of the invention, the composition of these coating layers is the following:

the first layer (inner) of alloy A1 contains iron, aluminium and zinc, the overall content of this layer being the following:

| | |
|---|---|
| A1 | Al between 15% and 45%<br>Fe between 5% and 25%<br>Zn forming the balance with addition elements in a small amount such as Mg, Sn, Ni, Cu, Cr, Mischmetal, etc . . . ; |

the second layer (outer) of alloy A2, disposed on the first layer contains zinc, aluminium and iron, and its overall content is the following:

| | |
|---|---|
| A2 | Al between 3% and 20%<br>Fe between 0.5% and 5%<br>Zn forming the balance with elements of addition in a small amount such as Mg, Zn, Ni, Cu, Cr, Mischmetal, etc . . . |

These layers are obtained by a manufacturing process in two stages.

The preparation of protective coatings in two stages has been known for a long time, but the prior processes do not describe voluntary heat treatments before and after the two immersions.

The first stage of the process according to the invention comprises a galvanization of the pure zinc by hot dipping in a bath of pure zinc followed by a controlled cooling and/or controlled heating (R1).

The second stage of this process is a dipping of the first galvanization coating in a bath of molten zinc-aluminium alloy having the following composition:

Al between 3% and 10%;

Zn forming the balance with elements of addition in a small amount: Mg, Sn, Cr, Ni, Cu, Mischmetal, etc . . . the total of which does not exceed 0.5%.

The dipping in this second bath followed by a controlled cooling and/or a controlled heating (R2), produces a considerable thermochemical modification of the coatings of alloy obtained by the first galvanization so as to result in the alloy A1 (Al-Zn-Fe).

Further, the layer of pure zinc of the first galvanization completely disappears and gives the layer of alloy A2 (Al-Zn-Fe).

These successive coolings and/or heatings thus produce a controlled diffusion thermochemical treatment.

These two layers have for respective overall compositions: A1 and A2.

There is therefore found a very high enrichment with aluminium of the inner layer, while the first bath contains only pure zinc.

The process of the invention therefore comprises two consecutive dippings with controlled cooling and/or controlled heating, so as to produce a controlled diffusion of Al and Fe.

The obtained wire as defined, has a resistance to corrosion which is very distinctly improved relative to that of conventional galvanized wires while it retains excellent characteristics of ductility and deformability (folding, winding, wiredrawing, etc . . . ).

It has been found that the resistance to accelerated corrosion in a saline mist according to the French standard ASTM B-117 of the wire of the present invention is at least double that of a conventional galvanized wire.

Moreover, the resistance to accelerated corrosion in a saline mist according to the French standard NFX41-002 (August 1975) of the wire of the invention is at least twice as high as that of a conventional galvanized wire, as shown by tests carried out. By way of illustrative numerical examples, for anticorrosion coatings of a thickness of 20 microns exposed to the saline mist, rust appeared at the end of about 150 hours on a conventional galvanized wire, and after 400 hours on a wire provided with a coating according to the invention. In respect of coatings of 40 microns in thickness, these times are respectively 300 hours and 800 hours.

It has also been ascertained that the cathodic protection in a chlorinated medium of the coating according to the invention is at least equal to that of a conventional galvanized wire.

Tests have also been carried out concerning corrosion in an $SO_2$ atmosphere, at 10 ppm $SO_2$, the following table of which shows the results expressed in loss of weight due to the corrosion for various specimens exposed to a 10 ppm $SO_2$ atmosphere and examined after three days, 1, 2, 3 and 4 weeks.

| $SO_2$ | THICKNESS OF THE COATING | 3 days | 1 week | 2 weeks | 3 weeks | 4 weeks |
|---|---|---|---|---|---|---|
| Wire of the invention | 64 g/m2<br>9μ | 21 | 28 | 40 | 57 | 51 |
| Galvanized wire | 71 g/m2<br>10μ | 65* | 58* | 11* | 63* | 464* |
| Galvanized wire | 150 g/m2<br>21μ | 76 | 122* | 112* | 105* | 134* |
| Wire of the invention | 142 g/m2<br>20μ | 20 | 28 | 58 | 66 | 73 |
| Galvanized wire | 228 g/m2<br>32μ | 67 | 105 | 190* | 184* | 157* |
| Wire of the invention | 228 g/m2<br>32μ | 20 | 27 | 62 | 75 | 104 |

$SO_2$ Resistance to corrosion of the wire of the invention and of the wire in a 10 ppm atmosphere.
The corrosion is expressed in loss of weight (g/m2).
*signifies that the steel is attacked.

The specimens were wound onto a mandrel having a diameter of 10 mm before the test.

The wires having a light coating of zinc (10 μm) exhibit red rust after three days of an exposure.

The galvanized wires having a coating thickness of 21 μm are corroded (with attack of the steel) after a week and those having a thickness of 35 μm reveal rust after two weeks of exposure.

No trace of red rust was observed on the specimens of wire according to the invention, even those having a thin coating (10 μm) after four weeks of exposure.

The resistance to corrosion of the wire obtained according to the invention is higher than that of similar coatings of Zn-Al but deposited in a single operation, without a controlled diffusion.

By way of example, the controlled cooling R1 of the wire as it leaves the first bath (pure zinc) was 20° C. per second, the heating before the second bath was 100° C. per second, the cooling R2 after the second bath (alloy containing zinc+Al+additions) was 100° C. per second.

What is claimed is:

1. A highly ductile hard steel wire having corrosion resistant superposed coatings, said wire being coated with a first inner Al-Fe-Zn alloy layer consisting essentially of between 15% and 45% Al, between 5% and 25% Fe and the balance being essentially Zn with minor amounts of one or more elements selected from the group consisting of Mg, Sn, Ni, Cu, Cr and mischmetal in an amount which does not exceed a total amount of 0.5% and a second outer alloy layer consisting essentially of between 3% and 20% Al, between 0.5% and 5% Fe and the remainder being essentially Zn with minor amounts, not to exceed a total amount of 0.5%, of one or more elements selected from the groups consisting of Mg, Sn, Ni, Cu, Cr, and Mischmetal.

* * * * *